US005600294A

United States Patent [19]

Buenconsejo et al.

[11] Patent Number: 5,600,294

[45] Date of Patent: Feb. 4, 1997

[54] INTERLOCKING BOBBIN AND CAP FOR ELECTROMAGNETIC COIL ASSEMBLY

[75] Inventors: Gary Buenconsejo; Keith A. Doehrman, both of Ft. Wayne; Lee M. Stanley, Columbia City; Henry J. Waring, Garrett, all of Ind.

[73] Assignee: Dana Corporation, Toledo, Ohio

[21] Appl. No.: 364,215

[22] Filed: Dec. 27, 1994

[51] Int. Cl.[6] ..... H01F 27/04; H01F 27/28

[52] U.S. Cl. ..... 336/192; 242/614; 336/208

[58] Field of Search ..... 336/192, 198, 336/208, 90; 242/118.4, 603, 614

[56] References Cited

U.S. PATENT DOCUMENTS

| | | | |
|---|---|---|---|
| 1,443,533 | 1/1923 | Hall et al. . | |
| 2,819,853 | 1/1958 | Kozlevcar . | |
| 3,230,490 | 1/1966 | Johnson | 336/198 |
| 3,358,255 | 12/1967 | Digilio | 336/198 |
| 3,560,903 | 2/1971 | Foldes et al. | 336/208 |
| 3,605,055 | 9/1971 | Grady | 336/208 |
| 3,739,312 | 6/1973 | Knebel . | |
| 4,424,505 | 1/1984 | Yatsushiro et al. . | |
| 4,596,974 | 6/1986 | Tobben et al. | 336/198 |
| 4,888,572 | 12/1989 | Tinley . | |
| 4,980,664 | 12/1990 | Harwood | 336/192 |

*Primary Examiner*—Thomas J. Kozma
*Attorney, Agent, or Firm*—MacMillan, Sobanski & Todd

[57] ABSTRACT

An electromagnetic coil assembly includes a bobbin upon which a coil of magnet wire is wound. The bobbin includes a body having first and second flanges formed at the ends thereof. First and second circumferentially spaced slots are formed through the first flange which receive the start and finish ends of the coil. A pair of lead wires are connected to the respective ends of the coil of the magnet wire. The bobbin futher includes an extension which extends from the first flange. A circumferential lip is formed at the axial end of the extension having an outer periphery which is non-circular in shape. A cap is provided to having an end wall and a circumferential sidewall. An opening is formed through the end wall of the cap and preferably has an inner periphery of the same general shape as the outer periphery of the lip formed on the extension of the bobbin. The cap is initially positioned axially adjacent to the first flange of the bobbin, then moved axially toward the first flange such that the lip formed on the extension passes through the opening formed through the cap. Next, the cap is rotated relative to the bobbin such that portions of the lip extend over portions of the end wall of the cap to prevent the cap from being removed axially from the extension of the bobbin. A pair of projections formed on edge of the sidewall of the cap are respectively received in the first and second slots to prevent further rotation of the cap relative to the bobbin. As a result, an annular protective space is provided between the cap and the first flange which covers the ends of the magnet wire and the connections with the ends of the lead wires. The two lead wires are also frictionally engaged between the first flange of the bobbin and the end wall of the cap to prevent the lead wires from being accidentally withdrawn from the electromagnetic coil assembly.

12 Claims, 2 Drawing Sheets

INTERLOCKING BOBBIN AND CAP FOR ELECTROMAGNETIC COIL ASSEMBLY

BACKGROUND OF THE INVENTION

This invention relates in general to electromagnetic coil assemblies and in particular to an interlocking bobbin and cap structure for use in such an electromagnetic coil assembly.

Electromagnetic coil assemblies are well known devices which are employed in a wide variety of applications. One basic structure for an electromagnetic coil assembly includes a bobbin formed of an electrically non-conductive material. The bobbin includes a generally cylindrical body (usually hollow) having enlarged end flanges provided at both ends thereof. An annular cavity is defined about the outer surface of the cylindrical body between the two end flanges, within which a length of an electrical conductor, such as a metallic wire, is wound. The two ends of the wound coil of the electrical conductor (commonly referred to as the magnet wire) are connected through respective lead wires to an external source of electrical current. When energized, the electrical current passing through the coil generates an electromagnetic field. This electromagnetic field can be used for many purposes, such as to cause movement of a movable component formed from a magnetically permeable material located near the coil.

To facilitate the connection of the two ends of the magnet wire to the respective lead wires, a pair of slots are usually formed through one of the end flanges of the bobbin. The first slot extends from the outer peripheral edge of the end flange radially inwardly to the outer surface of the cylindrical body of the bobbin. The start winding of the coil of magnet wire is threaded from the exterior surface of the end flange through this first slot to the cylindrical body of the bobbin to begin the winding process. The second slot extends from the outer peripheral edge of the end flange radially inwardly only partially toward the outer surface of the cylindrical body of the bobbin. The finish winding of the coil of magnet wire is threaded from the outer surface of the wound coil through this second slot to the exterior surface of the end flange of the bobbin. The two ends of the magnet wire are connected to the respective lead wires located on the exterior surface of the end flange of the bobbin.

In electromagnetic coil assemblies of this general type, it is important to provide secure connections between the two ends of the magnet wire and the respective lead wires. To accomplish this, the exterior surface of the end flange of the bobbin may be formed having labyrinth structure, through which the two lead wires are threaded. This labyrinth structure functions to frictionally retain the lead wires on the end flange of the bobbin, thereby preventing them from being accidentally withdrawn and becoming separated from the ends of the magnet wire. Also, adhesive tape may also be used to retain the two ends of the magnet wire and the respective lead wires together, preventing them from being disconnected from one another. Preferably, the adhesive tape is also formed from an electrically non-conductive material so as to electrically insulate the two connections and prevent a short circuit from occurring.

The feeding of the lead wires through the labyrinth structure and the application of the adhesive tape are operations which are typically performed by hand during manufacture of the electromagnetic coil assembly, especially when the physical size of the electromagnetic coil assembly is relatively small. Also, to insure that the connections between the two ends of the magnet wire and the respective lead wires are sufficiently insulated and that the lead wires will not be accidentally pulled out, a relatively large amount of the adhesive tape is also generally applied to the connections. As a result, the manufacture of electromagnetic coil assemblies of this general type is relatively slow and expensive. Thus, it would be desirable to provide an improved structure for an electromagnetic coil assembly which prevents the accidental withdrawal of the lead wires and which electrically insulates the connections between the two ends of the magnet wire and the respective lead wires, yet which is also relatively simple and inexpensive to construct and assemble.

SUMMARY OF THE INVENTION

This invention relates to an improved structure for an electromagnetic coil assembly including a bobbin upon which a coil of magnet wire is wound. The bobbin includes an elongated hollow cylindrical body defining an outer cylindrical surface. First and second flanges are formed at the ends of the body defining inwardly facing surfaces. The outer cylindrical surface of the body and the inwardly facing surfaces of the flanges define a hollow cylindrical space within which a length of an electrically conductive magnet wire can be wound to form a coil. First and second circumferentially spaced slots are formed through the first flange of the bobbin. The first slot extends from the outer peripheral edge of the first flange radially inwardly to the outer surface of the body and is adapted to receive a start end of the coil of the magnet wire. The second slot extends from the outer peripheral edge of the first flange partially radially inwardly and is adapted to receive a finish end of the coil of the magnet wire. A pair of lead wires are connected to the respective ends of the coil of the magnet wire. The bobbin is further formed having a hollow cylindrical extension which extends co-axially from the first flange. A lip is formed at the axial end of the extension which extends radially outwardly therefrom. The lip has an outer periphery which is non-circular in shape. A cap is provided having an end wall and a circumferential sidewall. An enlarged opening is formed through the end wall of the cap and preferably has an inner periphery of the same general shape as the outer periphery of the lip formed on the extension of the bobbin. The cap is positioned axially adjacent to the first flange of the bobbin, then moved axially toward the first flange such that the lip formed on the extension passes through the opening formed through the cap. Next, the cap is rotated relative to the bobbin such that portions of the lip extend over portions of the end wall of the cap to prevent the cap from being removed axially from the extension of the bobbin. A pair of projections formed on edge of the sidewall of the cap are respectively received in the first and second slots to prevent further rotation of the cap relative to the bobbin. As a result, an annular protective space is provided between the cap and the first flange of the bobbin which covers the ends of the magnet wire and the connections with the ends of the lead wires. The two lead wires are also frictionally engaged between the first flange of the bobbin and the end wall of the cap to prevent the lead wires from being accidentally withdrawn from the electromagnetic coil assembly during shipment and handling.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
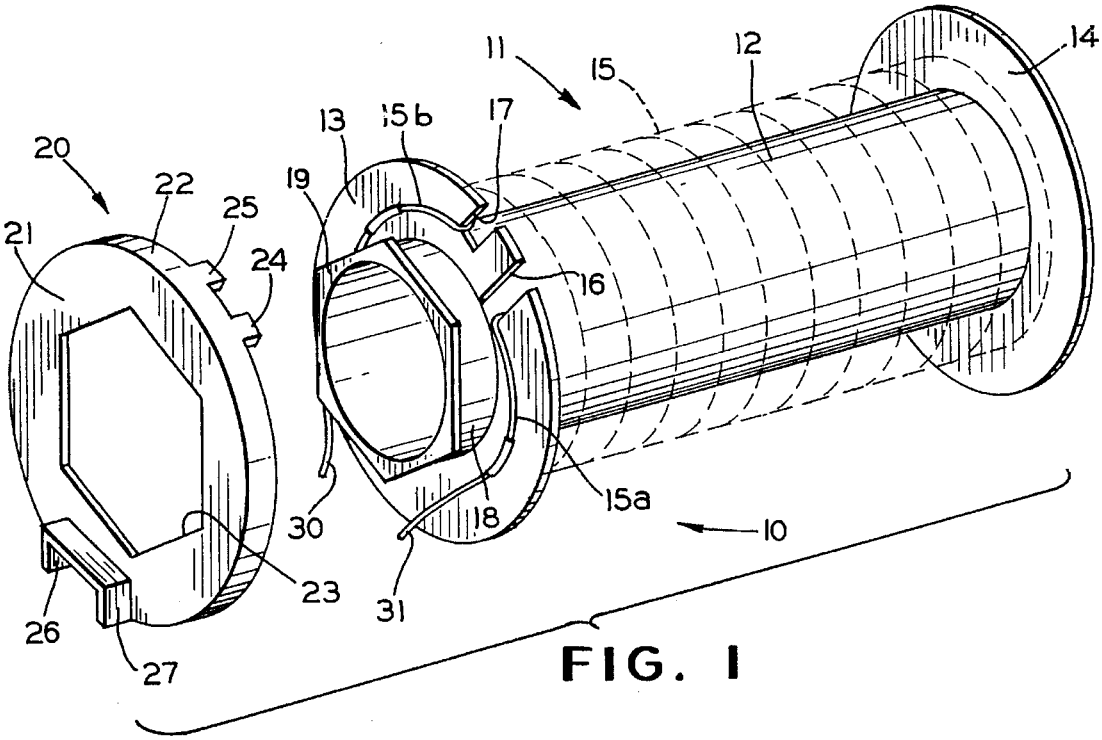
FIG. 1 is an exploded perspective view of an electromagnetic coil assembly including an interlocking bobbin and cap structure in accordance with this invention.

Referring now to the drawings, there is illustrated in FIG. 1 an electromagnetic coil assembly, indicated generally at 10, in accordance with this invention. The electromagnetic coil assembly 10 includes a bobbin, indicated generally at 11, which is preferably formed from an electrically non-conductive material, such as glass filled nylon. The bobbin 11 includes an elongated hollow cylindrical body 12 defining an outer cylindrical surface. First and second flanges 13 and 14 are formed at the ends of the body 12 defining inwardly facing surfaces. The outer cylindrical surface of the body 12 and the inwardly facing surfaces of the flanges 13 and 14 define a hollow cylindrical space, within which a length of an electrically conductive magnet wire can be wound to form a coil, indicated in dotted lines at 15. The coil of wire 15 may be wound upon the bobbin 11 in the conventional manner, preferably by using one of several well known automated winding machines. Although the illustrated flanges 13 and 14 are circular in shape, it will be appreciated that the flanges 13 and 14 may be formed in any other desired shape.

A first slot 16 is formed through the first flange 13 of the bobbin 11. The first slot 16 extends from the outer peripheral edge of the first flange 13 radially inwardly to the outer surface of the body 12. The first slot 16 is adapted to receive a first or start end 15*a* of the coil 15 of the magnet wire which is wound about the core 14, as will be described in greater detail below. A second slot 17 is also formed through the first flange 13 of the bobbin 11. As with the first slot 16, the second slot 17 extends from the outer peripheral edge of the first flange 13 radially inwardly. However, the second slot 17 does not extend completely to the outer surface of the body 12 of the bobbin 11. Rather, the second slot 17 terminates at a point which is intermediate the outer peripheral edge of the first flange 13 and the outer surface of the body 12. The second slot 17 is adapted to receive a second or finish end 15*b* of the coil 15 of the magnet wire which is wound about the core 14, as will also be described in greater detail below. The first and second slots 16 and 17 are circumferentially spaced apart from one another on the first flange 13 by a predetermined distance. The slots 16 and 17 may be formed having any desired shape and may be embodied as apertures formed through the first flange 13.

The bobbin 11 is further foraged having a hollow cylindrical extension 18 which extends co-axially from the first flange 13. Preferably, the extension 18 is sized and shaped similarly to the body 12 of the bobbin 11 and may be formed integrally therewith. A circumferential lip 19 is formed at the axial end of the extension 18. The lip 19 extends radially outwardly from the extension 18 and, in the illustrated embodiment, has an outer periphery which is generally hexagonal in shape. However, as will become apparent below, the outer periphery of the lip 19 may be formed having any polygonal or similar non-circular shape.

The electromagnetic coil assembly 10 futher includes a cap, indicated generally at 20. The cap 20 includes an end wall 21 and a circumferential sidewall 22 extending from one side of the end wall 21. An enlarged opening 23 is formed through the end wall 21 of the cap 20. The opening 23 is preferably formed having the same general shape as the lip 19 formed on the end of the extension 18 of the bobbin 11, but is slightly larger in size. Thus, in the illustrated embodiment, the inner periphery of the opening 23 is generally hexagonal in shape. However, as will become apparent below, the inner periphery of the opening 23 may be formed in any desired polygonal or similar non-circular shape, and may be formed having a shape which is different from the outer periphery of the lip 19.

Figure 3:
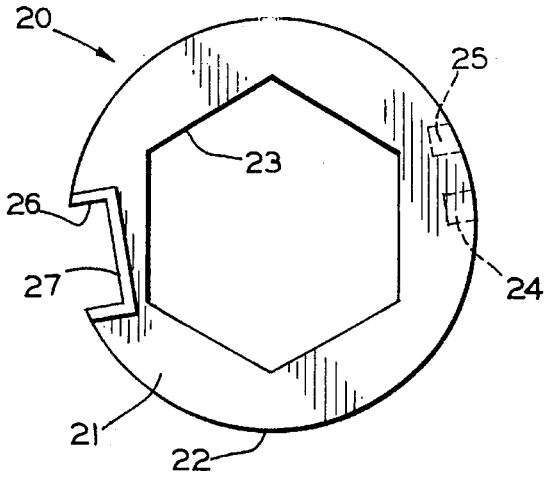
FIG. 3 is an end elevational view of the cap taken along line 3—3 of FIG. 2.
Figure 4:
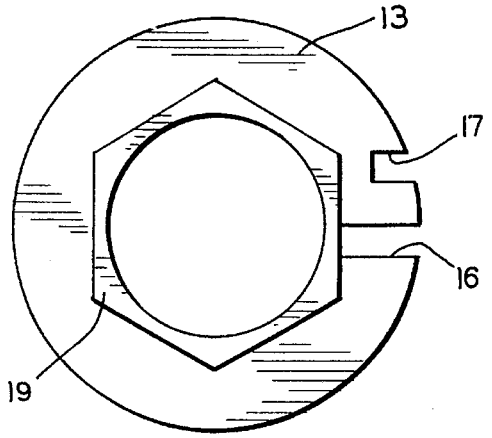
FIG. 4 is an end elevational view of the bobbin taken along line 4—4 of FIG. 2.

A pair of projections 24 and 25 are formed on edge of the sidewall 22 of the cap 20. The projections 24 and 25 extend axially from the edge of the sidewall 22 and are circumferentially spaced apart from one another by the same predetermined distance as the two slots 16 and 17 formed through the first flange 13 of the bobbin 11. The purposes for these projections 24 and 25 will be explained below. As best shown in FIG. 3, portions of the end wall 21 and sidewall 22 are interrupted by a slot 26 which extends radially inwardly only a short distance from the outer periphery of the cap 20. An upstanding guide flange 27 is formed about slot 26 on the side of the end wall 21 opposite the sidewall 22. The purposes of the slot 26 and the guide flange 27 will also be explained below. Like the bobbin 11, the cap 20 is preferably formed from an electrically non-conductive material, such as glass filled nylon.

To assemble the electromagnetic coil assembly 10 of this invention, the start end 15*a* of the magnet wire is threaded from the exterior surface of the first flange 13 through the first slot 16 to the outer surface of the body 12 of the bobbin 11. Then, using any conventional winding machine, the length of the magnet wire is wound repeatedly about the body 12 of the bobbin 11 so as to form the coil 15. Preferably, the coil 15 is wound by winding the magnet wire in a helical manner about the body 12 of the bobbin 11 so as to completely cover the outer surface thereof with a first layer extending from the first flange 13 to the second flange 14. Then, a second layer of the magnet wire is wound in the same helical manner (but in the reverse direction) over the first layer. Successive layers of the magnet wire can be similarly wound until a desired number of turns of the coil 15 of the magnet wire have been wound upon the bobbin 11. It will be appreciated that each layer of the magnet wire defines a diameter which is larger than the previous layer. Thus, the final layer of the coil 15 will be located at about the same radial location as the inner end of the second slot 17 formed through the first flange 13 of the bobbin 11. The finish end 15*b* of the magnet wire is threaded through the second slot 17 to the exterior surface of the first flange 13 of the bobbin 11.

The start end 15*a* and the finish end 15*b* of the coil 15 of the magnet wire are connected to respective insulated lead wires 30 and 31. These connections may be made in any suitable known manner, such as by soldering, welding, taping, or mechanical connectors. Preferably, the lead wires 30 and 31 are fed over the exterior surface of the first flange 13 of the bobbin 11 on opposite sides of the extension 18 to a location opposite from the first and second slots 16 and 17.

Figure 2:
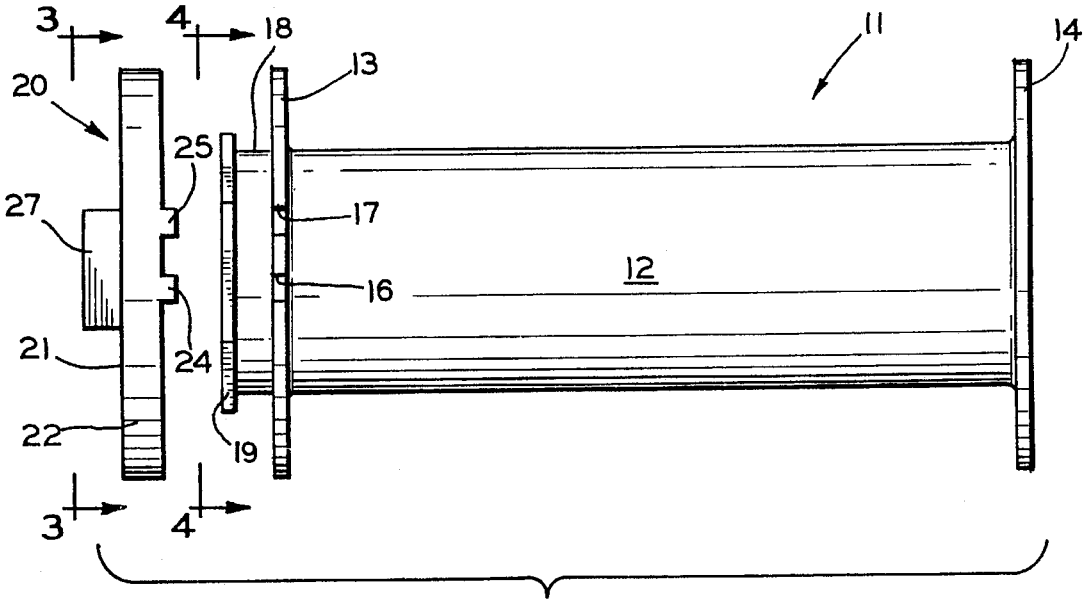
FIG. 2 is an exploded side elevational view of the interlocking bobbin and cap structure illustrated in FIG. 1.
Figure 5:
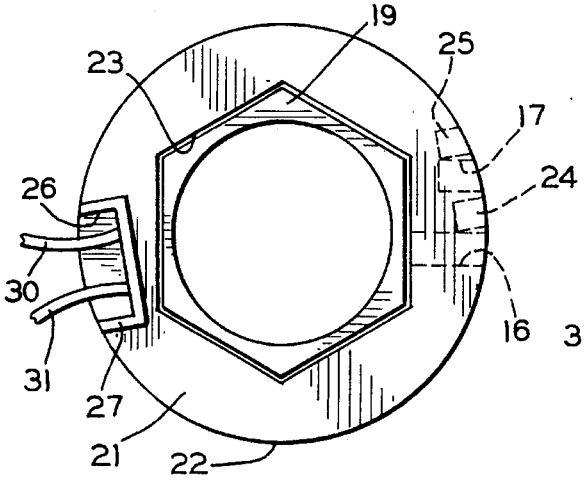
FIG. 5 is an end elevational view of the assembled interlocking bobbin and cap structure, wherein the cap is oriented in an unlocked position relative to the bobbin.

The cap 20 is provided to protectively cover the exposed start and finish ends 15*a* and 15*b* of the coil 15 of the magnet wire and the connections to the lead wires 30 and 31. To accomplish this, the cap 20 is initially positioned axially adjacent to the first flange 13 of the bobbin 11, as shown in FIG. 2. Then, the cap 20 is moved axially toward the first flange 13 such that the lip 19 formed on the extension 18 passes through the opening 23 formed through the cap 20, as shown in FIG. 5. During this movement, the two lead wires 30 and 31 are positioned so as to extend through the slot 26 formed through the cap 20. In this position, the two axially extending projections 24 and 25 formed on the sidewall 22 of the cap 20 are not circumferentially aligned with the first and second slots 16 and 17 formed through the first flange 13 of the bobbin 11. To accommodate this, the cap 20 must be sufficiently flexible to permit some amount of resilient bending of the end wall 21.

Figure 6:
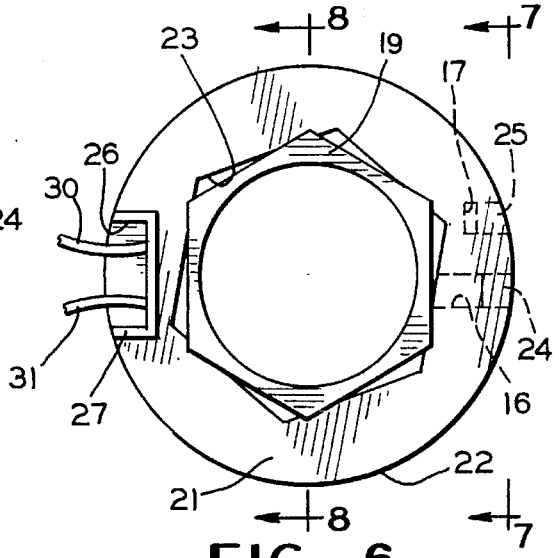
FIG. 6 is an end elevational view similar to FIG. 5, wherein the cap is oriented in a locked position relative to the bobbin.
Figure 7:
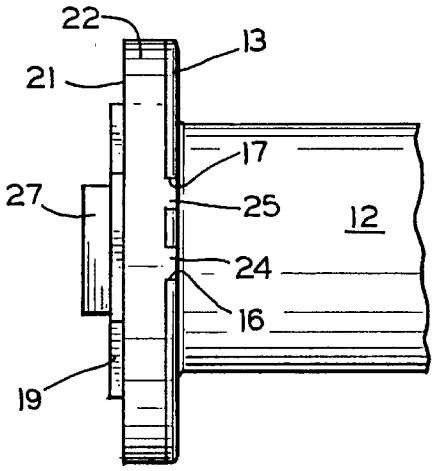
FIG. 7 is a fragmentary side elevational view of the assembled and locked interlocking bobbin and cap structure taken along line 7—7 of FIG. 6.

Next, the cap 20 is rotated relative to the bobbin 11 to the position illustrated in FIGS. 6 and 7. Because of the non-circular shapes of the outer periphery of the lip 19 and the inner periphery of the opening 23 formed through the end wall 21 of the cap 20, such relative rotation causes portions of the lip 19 to extend over portions of the end wall 21 of the cap 20, as best shown in FIG. 6. The overlapping portions of the lip 19 and the end wall 21 prevent the cap 21 from being removed axially from the extension 18 of the bobbin 11 until it is rotated to a relative orientation (such as shown in FIG. 5) where no such overlapping occurs. Consequently, the cap 20 is axially retained on the extension 18 of the bobbin 11.

The cap 20 is rotated relative to the bobbin 11 until the axially extending projections 24 and 25 are received within the first and second slots 16 and 17, respectively. Because of the above-described resilient bending of the end wall 21 of the cap 20 when initially installed on the bobbin 11, the projections 24 and 25 snap into the first and second slots 16 and 17 when properly aligned. As a result, further relative rotation between the cap 20 and the bobbin 11 is prevented. Because the cap 20 is thus prevented from rotating relative to the bobbin 11 to a relative orientation where no overlapping occurs between the lip 19 and the end wall 21, it can be seen that the cap 20 is securely retained on the extension 18 of the bobbin 11. In addition, the projections 24 and 25 close the outer ends of the first and second slots 16 and 17, thereby preventing undesirable access to the ends 15*a* and 15*b* of the magnet wire and to the connections with the ends of the lead wires 30 and 31.

Figure 8:
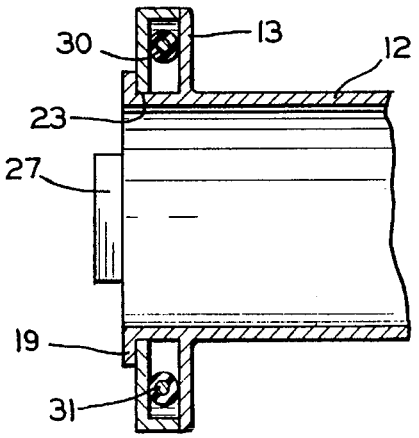
FIG. 8 is a fragmentary sectional elevational view of the assembled and locked interlocking bobbin and cap structure taken along line 8—8 of FIG. 6.

As best shown in FIG. 8, the installation of the cap 20 on the extension 18 of the bobbin 11 defines an annular protective space which extends axially between the exterior surface of the first flange 13 of the bobbin 11 and the end wall 21 of the cap 20 and radially between the outer surface of the extension 18 and the inner surface of the sidewall 22 of the cap 20. This protective space covers the ends 15*a* and 15*b* of the magnet wire and the connections with the ends of the lead wires 30 and 31. Additionally, the axial length of the sidewall 22 of the cap 20 can be selected to be slightly shorter than the outer diameter of the two lead wires 30 and 31. As a result, when the cap 20 is installed upon the extension 18 of the bobbin 11, the two lead wires 30 and 31 will be frictionally engaged between the exterior surface of the first flange 13 of the bobbin 11 and the end wall 21 of the cap 20. Such frictional engagement is desirable because it prevents the lead wires 30 and 31 from being accidentally withdrawn from the electromagnetic coil assembly 10 during shipment and handling.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An interlocking bobbin and cap structure adapted for use in an electromagnetic coil assembly comprising:

a bobbin including a body having an outer surface, first and second flanges formed on said body and extending outwardly from said outer surface, an extension extending from said first flange, and a lip formed on said extension defining an outer periphery which is non-circular in shape; and a cap including an end wall having an opening formed therethrough defining an inner periphery which is non-circular in shape, said extension of said bobbin extending through said opening of said cap, said cap being movable relative to said bobbin between a first position, wherein said outer periphery of said lip is aligned with said inner periphery of said opening of said cap, and a second position, wherein said outer periphery of said lip is not aligned with said inner periphery of said opening of said cap such that portions of said lip extend over portions of said end wall of said cap to retain said cap on said bobbin.

2. The interlocking bobbin and cap structure defined in claim 1 wherein said lip extends circumferentially about said extension.

3. The interlocking bobbin and cap structure defined in claim 1 wherein said cap further includes a sidewall extending from said end wall and engaging said first flange.

4. The interlocking bobbin and cap structure defined in claim 1 further including a slot formed in said first flange extending from an outer peripheral edge thereof to said outer surface of said body of said bobbin.

5. The interlocking bobbin and cap structure defined in claim 4 wherein said cap further includes a projection which extends into said slot to prevent relative movement between said cap and said bobbin when said cap is in said second position.

6. The interlocking bobbin and cap structure defined in claim 1 further including a first slot formed in said first flange extending from an outer peripheral edge thereof to said outer surface of said body of said bobbin and a second slot formed in said first flange extending partially from said outer peripheral edge thereof toward said outer surface of said body of said bobbin.

7. The interlocking bobbin and cap structure defined in claim 6 wherein said cap further includes a first projection which extends into said first slot and a second projection which extends into said second slot to prevent relative movement between said cap and said bobbin when said cap is in said second position.

8. The interlocking bobbin and cap structure defined in claim 1 further including means for selectively retaining said cap in said second position relative to said bobbin.

9. An electromagnetic coil assembly comprising:

a bobbin including a body having an outer surface, first and second flanges formed on said body and extending outwardly from said outer surface, an extension extending from said first flange, and a lip formed on said extension defining an outer periphery which is non-circular in shape;

a coil of an electrical conductor wound about said body of said bobbin between said first and second flanges; and a cap including an end wall having an opening formed therethrough defining an inner periphery which is non-circular in shape, said extension extending through said opening of said cap, said cap being movable relative to said extension between a first position, wherein said outer periphery of said lip is aligned with said inner periphery of said opening of said cap, and a second position, wherein said outer periphery of said lip is not aligned with said inner periphery of said opening of said cap such that portions of said lip extend over portions of said end wall of said cap to retain said cap on said bobbin.

10. The electromagnetic coil assembly defined in claim 9 further including means for selectively retaining said cap in said second position relative to said bobbin.

11. The electromagnetic coil assembly defined in claim 9 wherein said cap further includes a sidewall extending from said end wall and engaging said first flange, said endwall of said cap, said sidewall of said cap, and said first flange defining an annular space having an axial length which is smaller than an outer diameter of said electrical conductor.

12. The bobbin defined in claim 9 wherein said outer periphery of said lip is hexagonal in shape.

* * * * *